US009919432B1

(12) United States Patent
Morin et al.

(10) Patent No.: US 9,919,432 B1
(45) Date of Patent: Mar. 20, 2018

(54) HAND-HELD, SELF-POWERED PAVER MOVING TOOL WITH AN OPERATOR-SUPPORTED RECHARGEABLE VACUUM POWER PACK

(71) Applicants: David Paul Morin, Cheshire, MA (US); Thomas Michael Morin, Adams, MA (US)

(72) Inventors: David Paul Morin, Cheshire, MA (US); Thomas Michael Morin, Adams, MA (US)

( * ) Notice: Subject to any disclaimer, the term of this patent is extended or adjusted under 35 U.S.C. 154(b) by 0 days.

(21) Appl. No.: 15/493,641

(22) Filed: Apr. 21, 2017

Related U.S. Application Data

(60) Provisional application No. 62/326,184, filed on Apr. 22, 2016.

(51) Int. Cl.
*B25J 15/06* (2006.01)
*E01C 19/52* (2006.01)
*B65G 47/91* (2006.01)

(52) U.S. Cl.
CPC ..... *B25J 15/0691* (2013.01); *B25J 15/0625* (2013.01); *B65G 47/91* (2013.01); *B65G 47/917* (2013.01); *E01C 19/524* (2013.01); *E01C 19/526* (2013.01)

(58) Field of Classification Search
CPC .. B25J 15/0625; B25J 15/0633; B25J 15/065; B25J 15/0691; B65G 47/91; B65G 47/917; B66C 1/0225; B66C 1/0231; B66C 1/0256; B66C 1/0281; E01C 19/524; E01C 19/526
USPC ..... 294/185, 186, 189
See application file for complete search history.

(56) References Cited

U.S. PATENT DOCUMENTS 4,166,648 A * 9/1979 Creskoff ..... B66C 1/0231 294/189
4,931,341 A * 6/1990 Haffer ..... B65G 47/91 209/905
5,707,094 A * 1/1998 Gower ..... B66C 1/0218 294/188
5,795,001 A * 8/1998 Burke ..... B65G 49/061 294/185
5,850,882 A * 12/1998 Link ..... A01B 1/065 172/112
6,095,581 A * 8/2000 Brewer ..... B65G 47/91 294/186
6,682,049 B2 * 1/2004 Thompson ..... E01C 19/524 254/131

(Continued)

FOREIGN PATENT DOCUMENTS

DE 19646890 A1 * 5/1998 ..... B65G 47/91

*Primary Examiner* — Dean J Kramer
(74) *Attorney, Agent, or Firm* — Malcolm J. Chisholm, Jr.

(57) ABSTRACT

The paver moving tool (10) includes a suction head (12), a shaft (24) secured to the suction head (12), a lift-handle (30) secured to a top end (28) of the shaft (24), and one of a first and a second rechargeable vacuum power pack (34, 50) operably coupled in fluid communication with the suction head (12) for selectively applying a vacuum force through the suction head (12) to an adjacent paver (20). The rechargeable vacuum power packs (34, 50) are supported on either the shaft (24), the lift handle (30) or on a backpack (53) on an operator of the self-powered paver moving tool (10) while the operator is using the tool (10).

14 Claims, 7 Drawing Sheets

(56) References Cited

U.S. PATENT DOCUMENTS

| | | | | |
|---|---|---|---|---|
| 2010/0219651 | A1* | 9/2010 | Walter | B66C 1/0212 294/186 |
| 2011/0005088 | A1* | 1/2011 | Pellenc | B27B 17/0008 30/383 |
| 2015/0042280 | A1* | 2/2015 | Rief | H01M 2/1022 320/113 |

* cited by examiner

HAND-HELD, SELF-POWERED PAVER MOVING TOOL WITH AN OPERATOR-SUPPORTED RECHARGEABLE VACUUM POWER PACK

CROSS-REFERENCE TO RELATED APPLICATIONS

This application claims the benefit of U.S. Provisional Application No. 62/326,184 that was filed on 22 Apr. 2016 and which Provisional Patent Application was entitled "HAND-HELD, SELF-POWERED PAVER MOVING TOOL WITH AN OPERATOR-SUPPORTED VACUUM PUMP", and which is also incorporated herein by reference.

TECHNICAL FIELD

This disclosure relates to systems and apparatus for moving landscape pavers, such as stone, concrete and/or brick pavers, and especially relates to a hand-held paver moving tool having a suction head, a shaft extending from the suction head to a lift handle, and a rechargeable vacuum power pack for selectively supplying a vacuum force to the suction head.

BACKGROUND ART

It is well known that landscape pavers are increasingly popular for use in producing attractive patios, walkways, driveways, etc. Typically such landscape pavers are made from stone, concrete, brick, aggregate compounds, etc., and may be produced in varying colors. thicknesses and sizes depending upon particular requirements of a landscape site. Increasing use of such pavers and similar, hard materials in landscaping has given rise to the new term "hardscaping". Such pavers, however, are invariably quite heavy, ranging from 20 to 200 pounds, and require substantial manipulation to be processed from a palletized, transport condition, to storage at a landscape site, and then to final installation on a prepared surface at the site. Typically, such manipulation is done by hand by skilled masons and their assistants. This leads to great manual effort and substantial risk of injury to fingers, toes and backs of the workers. Additionally, such tedious manual moving of heavy pavers takes up substantial time, thereby raising costs of use of pavers compared to crushed rock, poured asphalt, etc.

Many efforts have been undertaken to enhance the safety and efficiency of moving pavers. For example, U.S. Pat. No. 6,682,049 to Thompson discloses use of one or more vacuum types of cups connected to a vacuum source and one or more shafts to lift, move and drop pavers or concrete blocks. Thompson, however, shows usage of a vacuum source and controls therefor that are remote from a handle connected to the shaft. Therefore, a vacuum must be applied to the vacuum cup for long durations prior to attachment to the concrete block, during moving thereof, and after detachment of the block, unless a control valve for the vacuum is actuated by a second worker. U.S. Pat. No. 4,946,335 to King et al. similarly shows a "suction lifting device", wherein a remote vacuum source is connected to "vacuum pucks" and the vacuum is controlled by actuators remote from the pavers or any handles of the device.

Use of a remote vacuum source and remote vacuum actuator controls for lifting pavers requires that a vacuum be applied to the suction well prior to application of the suction head to a paver, during the movement of the paver, and typically thereafter. This also requires either remote actuation of a vacuum valve, or some complicated mechanism at the vacuum cup to release the vacuum to thereby detach the vacuum cup from the paver. It is known that most such concrete block movers simply have a vacuum pump that is not actuated for each move, but that operates continuously and is therefore energy inefficient. Some known vacuum concrete block movers require peeling of the pliable vacuum cup off of the block to detach the vacuum cup from the block, thereby causing substantial wear and tear to the cup.

It is also known that hand-held paver moving systems have been operated through use of a standard air-compressor and tank, such as air compressors used to power pneumatic tools like nail guns, etc. A long hose passes between the compressor and the hand-held paver moving tool to apply a vacuum to a suction head of the tool. Such known paver moving systems involve a substantial risk of the hose becoming tangled in stacks of pavers, or an operator's feet, causing risk of injury to the operator. Additionally, a heavy paver may be accidentally dropped on the hose causing further damage. Also, this known system requires the substantial power and cost of utilizing an expensive air compressor and related filters and hoses, etc.

Consequently, there is a need for a paver moving tool that maximizes worker safety and that minimizes labor and energy costs.

SUMMARY OF THE DISCLOSURE

The disclosure is a hand-held, self-powered paver moving tool with an operator-supported rechargeable vacuum power pack. The paver moving tool includes a suction head having a contact surface and an opposed attachment surface. The contact surface is configured to be detachably secured adjacent an approximately flat, surface of a paver. The suction head defines a suction-head throughbore passing between the contact surface and the attachment surface of the head. A shaft, having a bottom end and an opposed top end of the shaft, is secured at the bottom end of the shaft to the attachment surface of the suction head. A lift-handle is secured to the top end of the shaft. Also, a rechargeable vacuum power pack is operably coupled in fluid communication with the contact surface of the suction head. The rechargeable vacuum power pack selectively applies a vacuum force through the suction-head throughbore to the contact surface of the suction head. The rechargeable vacuum power pack is configured to be supported or carried by an operator of the self-powered paver moving tool while the operator is using the paver moving tool.

The rechargeable vacuum power pack of the hand-held, self-powered paver moving tool includes a vacuum pump that is secured to a support, assembly of the power pack. The power pack also includes a suction line that extends in fluid communication between the vacuum pump and the suction-head throughbore of the suction head. A rechargeable battery is detachably secured to a battery mount on the support assembly. An electrical circuit extends in electrical communication between the battery and a vacuum-pump switch secured to the lift handle. The electrical circuit also extends between the battery and the vacuum pump and is configured to selectively provide power to operate the vacuum pump by operation of the vacuum-pump switch.

In another and alternative embodiment, the hand-held, self-powered paver moving tool may also include a vent valve secured to the suction line. The vent valve is configured to selectively and adjustably permit release of either a portion of, or all of the vacuum force within the suction line.

In another and alternative embodiment of the present paver moving tool, the vent valve is an electrically actuated vent valve that is secured to the suction line and that is also secured in electrical communication with the power source and with a vent-valve switch secured to the lift-handle adjacent the vacuum-pump switch. The vacuum-pump switch and the vent-valve switch are configured for selective operation by an operator's hand that is simultaneously lifting the lift-handle.

In yet another and alternative embodiment of the paver moving tool, the vacuum-pump switch on the lift-handle is an on/off toggle switch. Also on the lift-handle is a spring-biased quick-switch that is secured adjacent the on/off toggle switch. The quick-switch is secured in electrical communication between the power source and the vacuum pump. The quick-switch selectively permits and prevents operation of the vacuum pump upon compression and release of the spring-biased quick-switch. For long duration application of a vacuum, the on/off toggle switch would be used. For a short duration use, compression of the quick-switch would be used. That switch would automatically prevent operation of the vacuum pump upon release or decompression of the quick-switch, such as upon removal of a finger of the operator from the quick-switch.

In a further and alternative embodiment of the paver moving tool, the suction line that extends between the vacuum pump and the suction-head throughbore includes a first section and a second section. The first section of the suction line extends between the vacuum pump and either the shaft or the lift handle. The second section of the suction line is in the form of a suction throughbore defined within either only the shaft, or the lift handle and the shaft. The second section or suction throughbore extends from either a position on the shaft above the bottom end of the shaft to the bottom end of the shaft, or from and through the lift handle and through the shaft and into the suction-head throughbore of the suction head.

In another and alternative embodiment of the paver moving tool, the battery mount includes electrical contacts configured to be in contact with electrical contacts of the detachable, rechargeable battery. Additionally, electrical contacts of the battery mount are positioned to be below electrical contacts of the battery, wherein below is with respect to the direction of the force of gravity. This helps assure contact between the electrical contacts of the battery and the electrical contacts of battery mount whenever the power pack abruptly stops a motion toward the surface of the earth, such as in positioning pavers onto the surface.

In a further and alternative embodiment of the paver moving tool, the battery mount includes an adjustable-length, pliable securing strap for separately securing varying size batteries within the battery mount. This provides for use of standard lithium-ion rechargeable battery used in common power tools, wherein a twelve-volt or eighteen-volt battery can be secured within the battery mount.

In an additional and alternative embodiment, the paver moving tool may also include a low-battery power signal secured to the lift handle or the shaft that emits a visual signal (such as a flashing light) and/or an audio signal (such as a sound alarm). The low-battery power signal is secured in electrical communication with the battery. The low-battery signal is configured to warn an operator whenever battery power decreases below a pre-determined minimum amount of power so that an operator will stop using the paver tool prior to loss of adequate battery power to thereby avoid injury to the operator and/or a paver being moved by the paver tool.

In another and alternative embodiment of the paver moving tool, the lift handle further comprises an "H"-shaped, two-person lift handle. The two-person lift handle may be utilized with the rechargeable vacuum power pack secured to the shaft or lift handle of the tool, or with the rechargeable vacuum power pack secured to a backpack supported by an operator during operation of the paver moving tool. Also, the "H"-shaped two-person lift handle is configured to provide four lifting hand-grips at the four corners of the "H"-shaped handle, with control switches adjacent one of the hand-grips. This facilitates use of the paver moving tool by two operators for lifting very heavy pavers.

In another and alternative embodiment of the paver moving tool, the vacuum-pump switch is positioned adjacent one of the four lifting hand-grips of the two-person lift handle.

In yet another and alternative embodiment of the paver moving tool, the rechargeable vacuum power pack is secured to one of the shaft and the lift-handle. In this embodiment, the operator supports or carries the rechargeable vacuum power pack by lifting the life handle.

In yet another and alternative embodiment of the paver moving tool, the rechargeable vacuum power pack is secured to a backpack configured to be supported on a back of an operator during operation of the paver moving tool.

In another and alternative embodiment of the paver moving tool, the tool includes a plurality of different sized suction heads configured to be detachably secured to the shaft.

In a further and alternative embodiment of the paver moving tool, the suction head includes a descending lip of compressible, gas-impermeable material secured adjacent a perimeter edge of the contact surface of the suction head, and extending below the contact surface in a direction away from the attachment surface of the suction head. This compressible lip facilitates application of the vacuum force between the contact surface and a paver so that the paver moving tool may lift and move the paver as the vacuum force is applied to the paver.

In yet another and alternative embodiment of the paver moving tool with an operator-supported rechargeable vacuum power pack, the power pack includes a plurality of battery mounts for securing a plurality of batteries.

The present hand-held, self-powered paver moving tool with an operator-supported rechargeable vacuum power pack increases efficiency of use and maximizes worker safety compared to known paver moving systems that utilize remote power supplies and complicated lifting apparatus.

PREFERRED EMBODIMENTS OF THE DISCLOSURE

Figure 1:
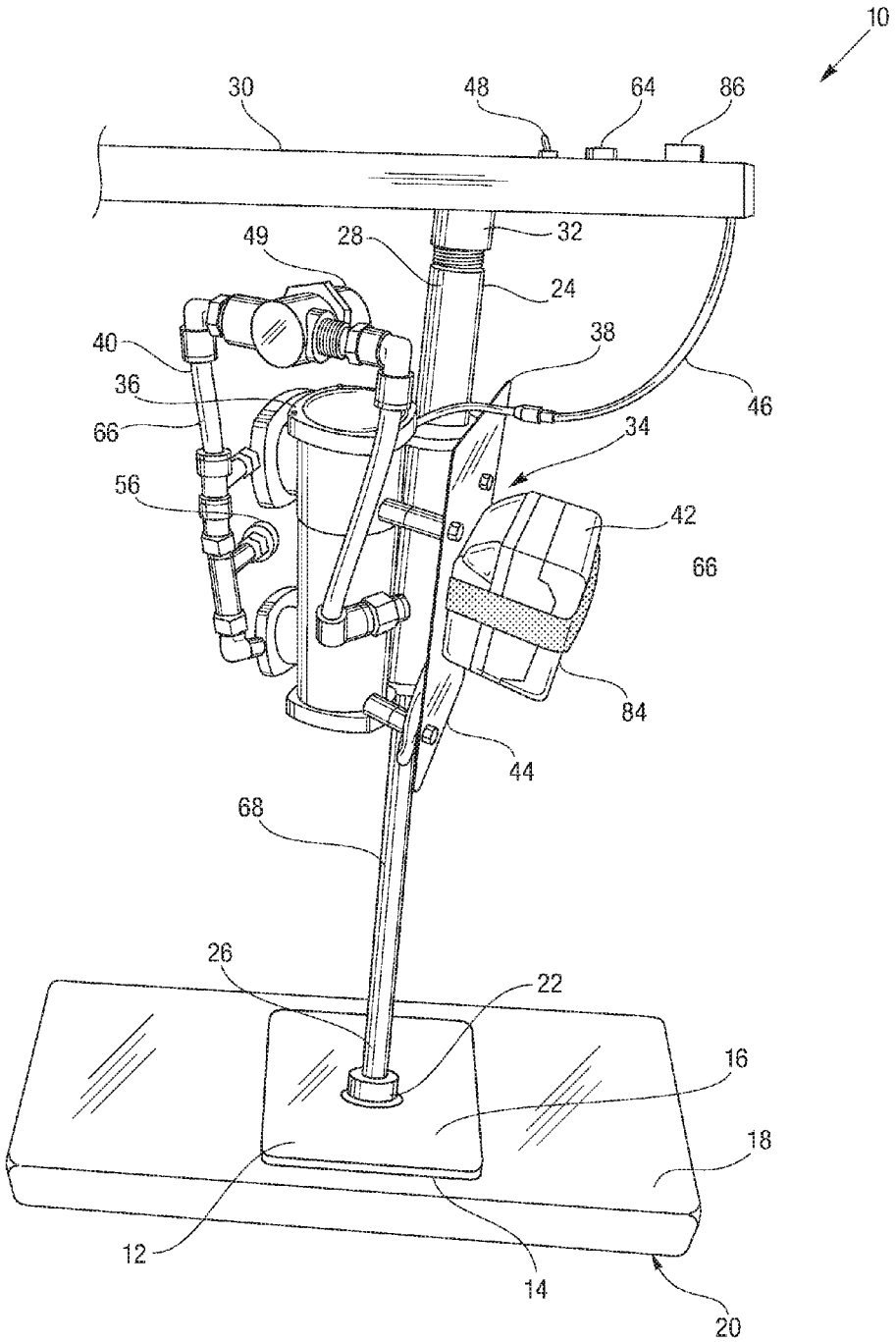
FIG. 1 is a top perspective view of a hand-held, self-powered paver moving tool with an operator-supported rechargeable vacuum power pack constructed in accordance with the present invention and showing a suction head of the paver moving tool placed upon a paver.

Referring to the drawings in detail, FIG. 1 shows a hand-held/self-powered paver moving tool with an operator-supported rechargeable vacuum power pack of the present disclosure and that is generally designated by the reference numeral 10. The paver moving tool 10 includes a suction head 12 having a contact surface 14 and an opposed attachment surface 16. The contact surface 34 is configured to be detachably secured adjacent an approximately flat surface 18 of a paver 20. The suction head 12 defines a suction-head throughbore 22 (shown best in FIG. 7) passing between the contact surface 14 and the attachment surface 16 of the head 12. A shaft 24, having a bottom end 26 and an opposed top end 28 of the shaft 24, is secured at the bottom end 26 of the shaft 24 to the attachment surface 16 of the suction head 12. A lift-handle 30 is secured to the top end 28 of the shaft 24 by a handle coupling 32.

FIG. 1 shows a first rechargeable vacuum power pack 34 that is operably coupled in fluid communication with the contact surface 14 of the suction head 12. The first rechargeable vacuum power pack 34 selectively applies a vacuum force through the suction-head throughbore 22 to the contact surface 14 of the suction head 12. The FIG. 1 first rechargeable vacuum power pack 34 is configured to be supported or carried by an operator (not shown) of the self-powered paver moving tool 10 while the operator is using the paver moving tool 10.

Figure 3:
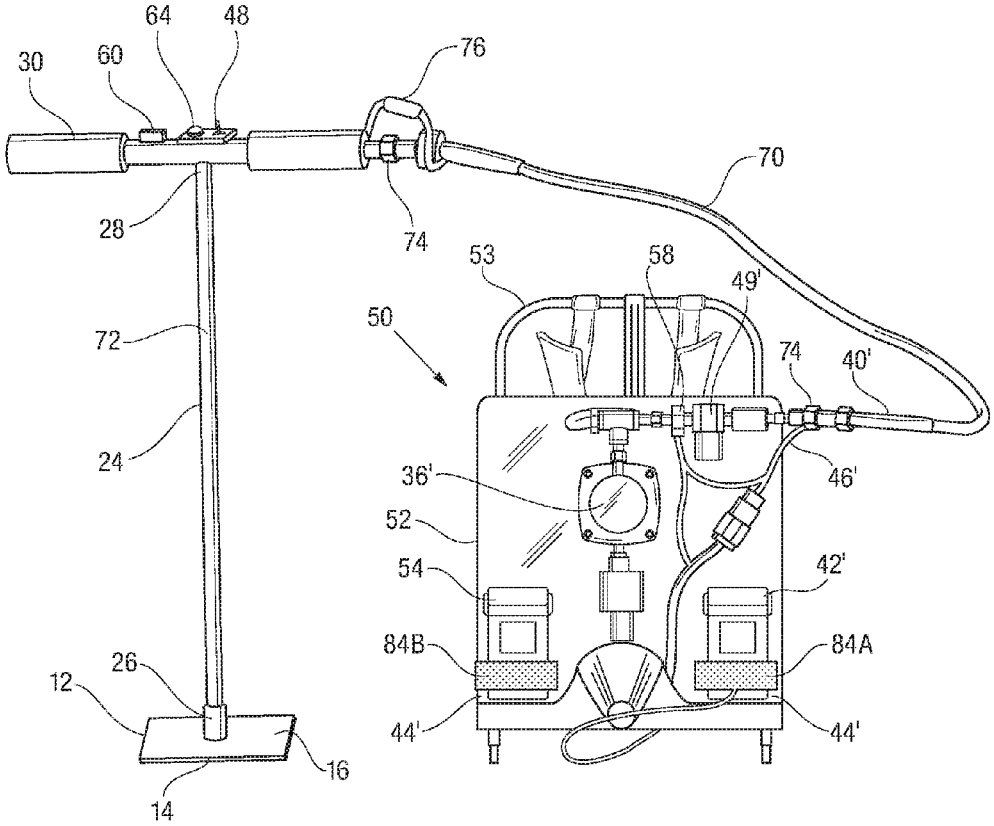
FIG. 3 is a front plan view of a hand-held, self-powered paver moving tool with an operator-supported rechargeable vacuum power pack constructed in accordance with the present invention and showing the rechargeable vacuum power pack secured to a backpack.
Figure 4:
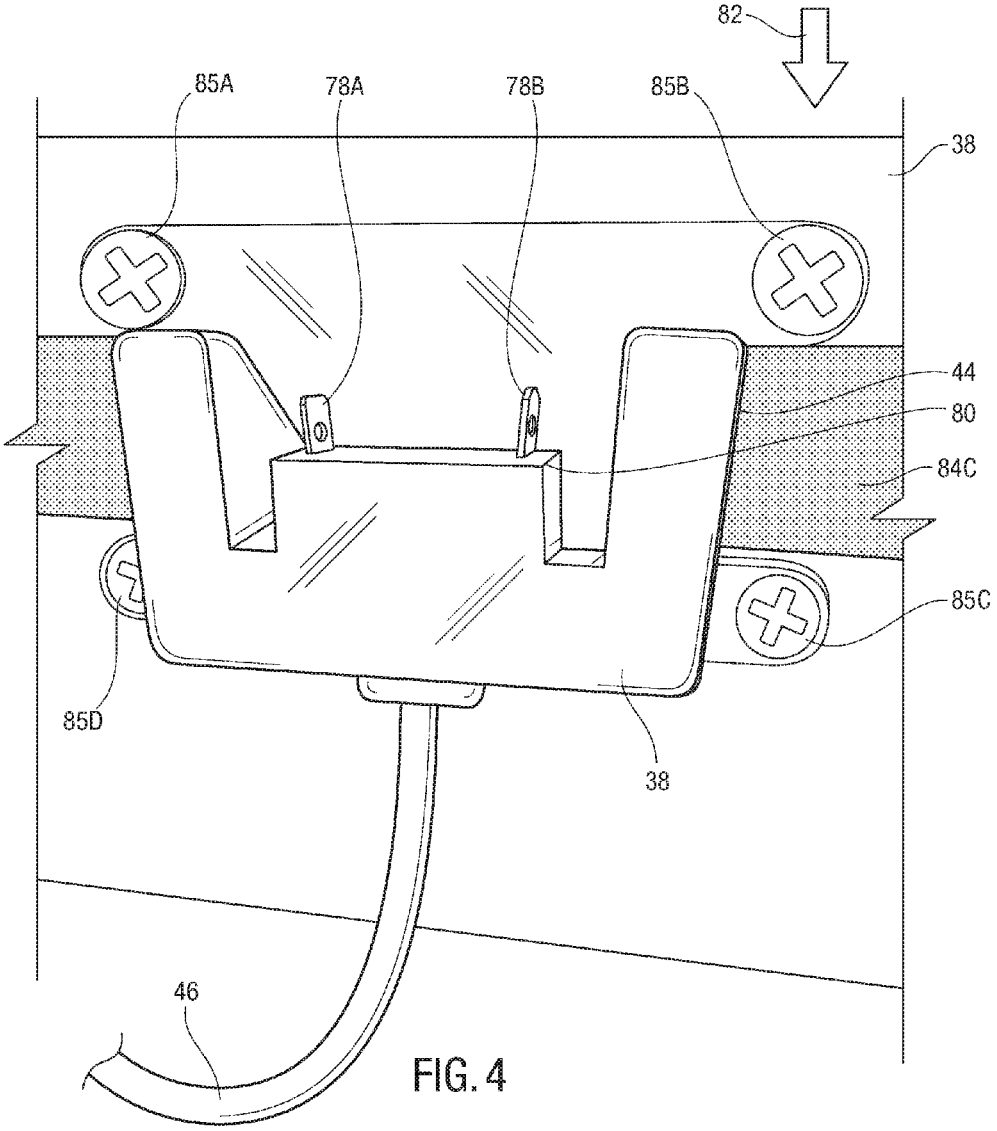
FIG. 4 is a front plan view of a battery mount utilized to secure a rechargeable battery to the rechargeable vacuum power pack and including an arrow showing a direction of the force of gravity.

FIG. 1 shows the first rechargeable vacuum power pack 34 of the hand-held, self-powered paver moving tool 10. The first rechargeable vacuum power pack 34 includes a first vacuum pump 36 that is secured to a first support assembly 38 of the power pack 34. The first power pack 34 also includes a first suction line 40 that extends in fluid communication between the first vacuum pump 36 and the suction-head throughbore 22 of the suction head 12. A first rechargeable battery 42 is detachably secured to a first battery mount 44 on the first support assembly 38, as best shown in FIG. 4. A first electrical circuit 46 extends in electrical communication between the first rechargeable battery 42 and a vacuum-pump switch 48 secured to the lift handle 30. The electrical circuit 46 also extends between the first battery 42 and the first vacuum pump 36 and is configured to selectively provide power to operate the vacuum pump 36 by operation of the vacuum-pump switch 48. FIG. 3 also shows a transparent particle filter 49 in fluid communication with the first suction line 40 so that any accumulated particles can be readily identified and removed from the filter 49 prior to eliminate any reduction in performance of the first rechargeable battery power pack 34.

FIG. 3 shows a second rechargeable vacuum power pack 50 of the hand-held, self-powered paver moving tool 10. (Components of the second power pack 50 that are virtually identical to components of the first power pack are designated by reference numerals having primes of the reference numerals associated with the first rechargeable vacuum power pack 34. For example, the first vacuum pump is designated by the reference numeral 36, and the second vacuum pump is designated by the reference numeral 36'.) The second rechargeable vacuum power pack 50 includes a second vacuum pump 36' that is secured to a second support assembly 52 of the second power pack 50. The second support 52 assembly is secured to a backpack 53 so that the second power pack 50 may be supported on the back of an operator (not shown) during operation of the paver moving tool 10. The second power pack 50 also includes a second suction line 40' that extends in fluid communication between the second vacuum pump 36 and the suction-head throughbore 22 of the suction head 12. A second a transparent particle filter 49' is also secured in fluid communication with the second suction line 40'. A second rechargeable battery 42 is detachably secured to a second battery mount 44 on the second support assembly 38, as best shown in FIG. 4. A second electrical circuit 46' extends in electrical communication between the second rechargeable battery 42' and a vacuum-pump switch 48 secured to the lift handle 30. (Both the first and second rechargeable vacuum power packs 34, 50 may include a plurality of rechargeable batteries 42, 42', and FIG. 3 shows an additional rechargeable battery 54.) The second electrical circuit 46' also extends between the second battery 42' and the second vacuum pump 36' and is also configured to selectively provide power to operate the vacuum pump 36' by operation of the vacuum-pump switch 48.

FIG. 1 shows that the hand-held, self-powered paver moving tool 10 utilizing the first rechargeable vacuum power pack 34 may also include a vent valve 56 secured to the first suction line 40. The vent valve 56 is configured to selectively and adjustably permit release of either a portion of, or all of a vacuum force within the suction line 40.

FIG. 3 shows that the paver moving tool may also include an electrically actuated vent valve 58 that is secured to the suction line 40' and that is also secured in electrical communication with the second rechargeable battery 42' power source. A vent-valve switch 60 is secured to the lift-handle 30 adjacent the vacuum-pump switch 48. The vacuum-pump switch 48 and the vent-valve switch 60 are configured for selective operation by an operator's hand (not shown) that is simultaneously lifting the lift-handle 30.

Figure 2:
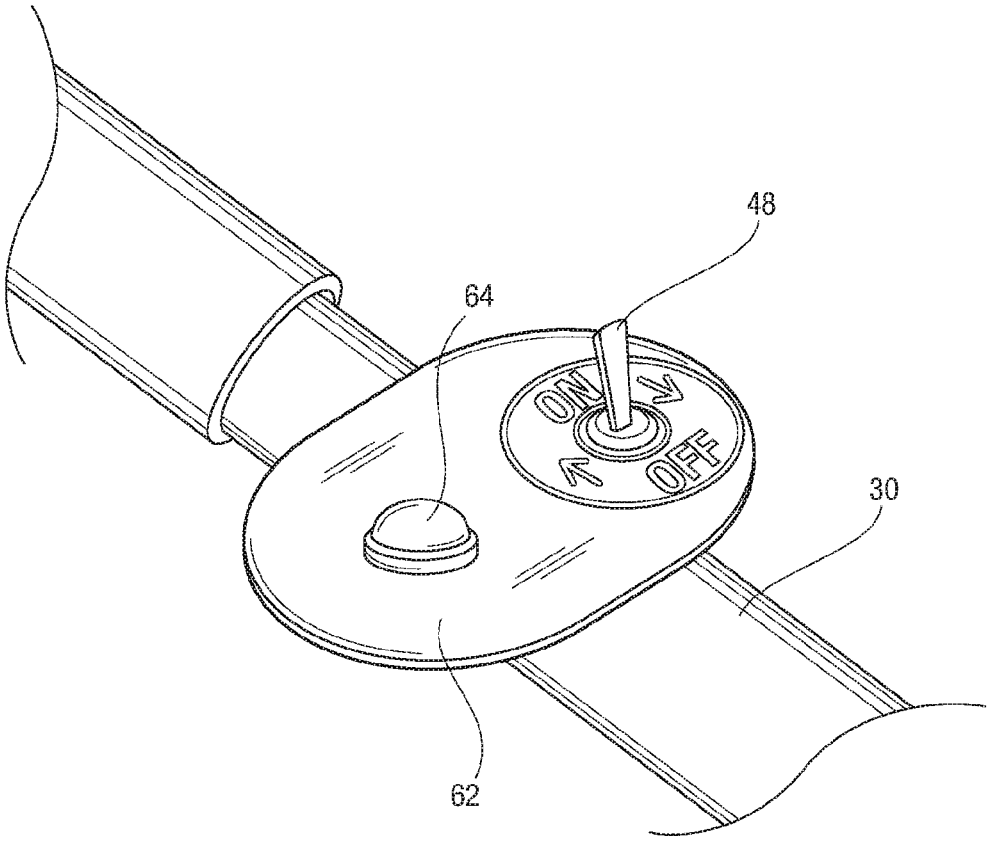
FIG. 2 is a fragmentary view of an on/off toggle switch adjacent a spring-biased quick-switch secured to a lift handle of the present hand-held, self-powered paver moving tool.

As best shown in FIG. 2, the vacuum-pump switch 48 may be secured to a switch plate 62 secured to the lift-handle 30 as an on/off toggle switch 48. Also on the switch plate 62 (or directly on the lift handle 30, not shown) is a spring-biased quick-switch 64 that is secured adjacent the on/off toggle switch 48. As described above, the quick-switch 64 is secured in electrical communication through the electrical circuit 46, 46' between the rechargeable battery 42, 42' power source and the vacuum pump 36, 36'. The quick-switch 64 selectively permits and prevents operation of the vacuum pump 36, 36' upon compression and release of the spring-biased quick-switch 64. For long duration application of a vacuum, the on/off toggle switch 48 would be used. For a short duration use, compression of the quick-switch 64 would be used. That switch would automatically prevent operation of the vacuum pump 36, 36' upon release or decompression of the quick-switch 64, such as upon removal of a finger (not shown) of the operator from the quick-switch 64.

As best shown in the FIG. 1 paver moving tool 10, the suction line 40 that extends between the vacuum pump 36 and the suction-head throughbore 22 includes a first section 66 and a second section 68. The first section 66 of the suction line 40 extends between the vacuum pump 36 and the shaft 24. The second section 68 of the suction line 40 is in the form of a suction throughbore defined within the shaft 24. The second section 68 or suction throughbore 68 extends from either a position on the shaft 24 above the bottom end 26 of the shaft to the bottom end 26 of the shaft 24, and through the shaft and into the suction-head throughbore 22 of the suction head 12. As shown in FIG. 3, the second suction line 40' also includes a first section 70 that extends from the second vacuum pump 36' to the lift handle 30. A second section 72 of the second suction line 40' is in the form of a throughbore within the lift handle 30 and the shaft 24 so that a suction force may be applied from the second vacuum pump 36' through the first and second sections 70, 72 of the second suction line 40' into the suction head throughbore 22 of the suction head 12.

As best shown in FIG. 3, the suction line 70 and the second electrical circuit 46' (as with similar component throughout the paver moving tool 10) include standard vacuum-line couplers 74 and electrical line couplers 76 to facilitate disassembly of the paver moving tool for transport and storage thereof, etc.

The battery mount 44, best shown in FIG. 4, is utilized in the first and second rechargeable vacuum power packs 34, 50. The battery mount 44 includes electrical contacts 78A, 78B protruding above a contact block 80 that is configured to receive "off-the-shelf" rechargeable batteries 42, 42', 54. The electrical contacts 78A, 78B of the battery mount 44, 44' are dimensioned to detachably mate in electrical communication with electrical contacts (not shown) of the rechargeable batteries 42, 42', 54. More importantly, the electrical contacts 78A, 78B of the battery mount 44, 44' are positioned to be below electrical contacts (not shown) of the rechargeable battery 42, 42', 54, wherein below is with respect to the direction 82 of the force of gravity. This helps assure contact between the electrical contacts of the rechargeable battery 42, 42', 54 and the electrical contacts (not shown) of the battery mount 44, 44' whenever the power pack 34, 50 abruptly stops a motion toward the surface of the earth or in the direction 82 of gravity, such as in positioning a paver 20 onto the ground. The battery mount 44, 44' may be secured to the lift assembly 38 by a plurality of fasteners, such as screw fasteners 85A, 85B, 85C, 85D.

The battery mounts 44, 44' also include adjustable-length, pliable securing straps 84A, 84B, 84C (shown best in FIGS. 1, 3 and 4) for separately securing varying size batteries 42, 42', 54 within the battery mount 44, 44'. This provides for use of standard lithium-ion rechargeable batteries used in common power tools, wherein a twelve-volt or eighteen-volt battery can be secured within the battery mount. An exemplary rechargeable battery is available from the Milwaukee Tool company, and is identified as a "Milwaukee 48-11-1828 M18 XC RED LITHIUM 18-Volt Lithium-ion Cordless Tool Battery". It is also noted that an exemplary vacuum pump is available from the THOMAS pump company under name of the "910 Series diaphragm pump", as disclosed at a website having a domain name of: gdthomas.com/diaphragm/gas/910series/.

FIG. 1 shows a low-battery power signal 66 secured to the lift handle 30 or the shaft 24 that emits a visual signal (such as a flashing light) and/or an audio signal (such as a sound alarm). The low-battery power signal 36 is secured in electrical communication via the first electrical circuit 46 with the rechargeable battery 42. The low-battery signal 86 (shown only in FIG. 1) is configured to warn an operator (not shown) whenever battery power decreases below a predetermined minimum amount of power so that an operator will stop using the paver tool 10 prior to loss of adequate battery power to thereby avoid injury to the operator and/or a paver 20 being moved by the paver tool 10.

Figure 5:
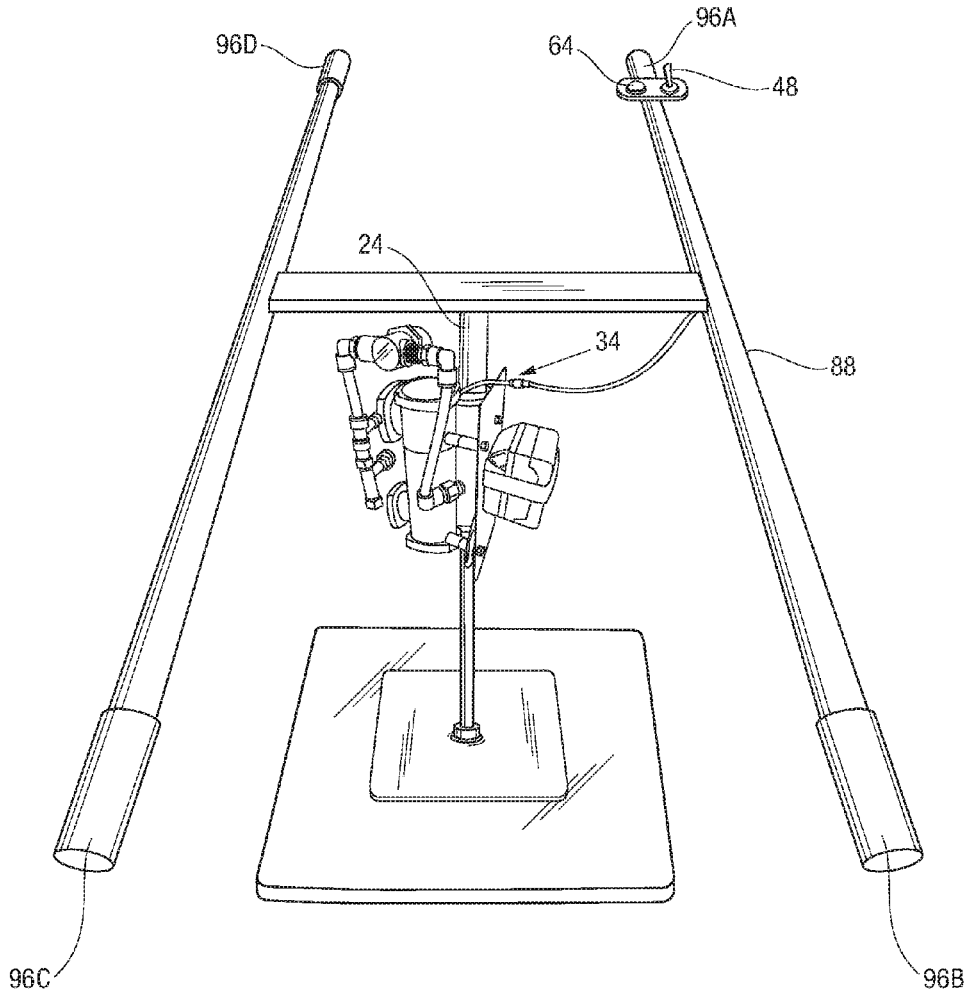
FIG. 5 is a top perspective view of a hand-held, self-powered paver moving tool with an operator-supported rechargeable vacuum power pack showing the rechargeable vacuum power pack secured to a shaft of the paver moving tool, and showing a lift handle of the paver moving tool in the form of an "H"-shaped, two-person lift handle.
Figure 6:
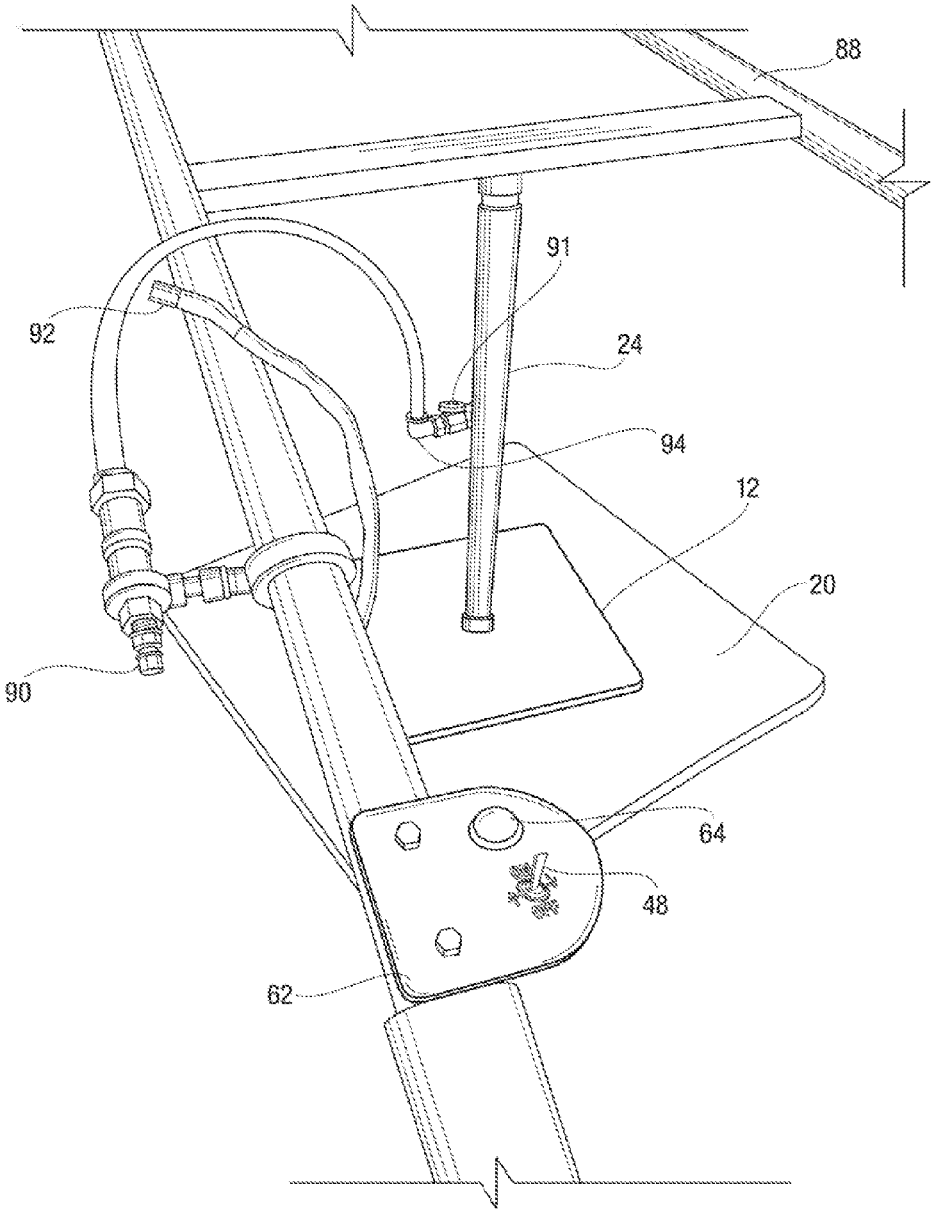
FIG. 6 is a top perspective view of a hand-held, self-powered paver moving tool with a lift handle of the paver moving tool in the form of an "H"-shaped, two-person lift handle, and showing a suction line coupler and an electrical circuit coupler secured to the two-person lift handle for coupling the two-person lift handle to a suction line and an electrical circuit of a rechargeable vacuum power pack secured to a backpack.

FIGS. 5 and 6 show that the paver moving tool 10 may utilize an "H"-shaped, two-person lift handle 88. The two-person lift handle 88 may be utilized with the first rechargeable vacuum power pack 34 secured to the shaft 24 (as shown in FIG. 5) or secured to a location (not shown) upon the two-person lift handle 88 of the paver moving tool 10. Alternatively, and as shown in FIG. 6, the "H"-shaped two person lift handle 88 may be configured to include a suction line coupler 90 and an electrical, circuit coupler 92 so that the two-person lift handle 88 may be coupled to the second rechargeable vacuum power pack 50 that is secured to a backpack 53. The suction line coupler 90 may also include a second, mechanically adjustable vent valve 91 secured in fluid communication with the suction line coupler 90 and the shaft 24. As with the vent valve 56 shown in FIG. 1, the second vent valve 91 is typically opened just enough by the operator (not shown) to have the suction head release immediately after turning off the vacuum pump 36' rather than waiting for a slow vacuum release, or for peeling off the suction head. The operator may adjust the second vent valve 91 to a specific convenience level depending upon factors such as the weight of the paver being lifted, the power of the vacuum pump 36, etc. The FIG. 1 vent valve 56 would also be controlled by the operator in a similar manner.

In this FIG. 6 embodiment, the first section 70 second suction line 40' extends to a shaft suction line coupler 94 on the shaft 24. The second section 72 of the second suction line 40' then extends as a throughbore within and through the shaft 24 and through the suction head 12.

Also, the "H"-shaped two-person lift handle 88 is configured to provide four lifting hand-grips 96A, 96B, 96C and 96D at the four corners of the "H"-shaped, two-person handle 88. The handle 88 also has an on/off toggle vacuum control switch 48 and a spring-biased quick switch 64 adjacent one of the hand-grips 96A. This facilitates use of the paver moving tool 10 by two operators for lifting very heavy pavers.

As shown in FIG. 1, the paver moving tool 10 may have the first rechargeable vacuum power pack 42 is secured to the shaft 24. Alternatively, the first rechargeable vacuum power pack 42 may be secured (not shown) to the lift-handle 30. In the FIG. 1 embodiment, the operator (not shown) supports or carries the first rechargeable vacuum power pack 42 by lifting the lift handle 30.

As shown in FIG. 3, the second rechargeable vacuum power pack 50 is secured to the backpack 53, and is thereby configured to be supported on a back of an operator (not shown) during operation of the paver moving tool 10.

Figure 7:
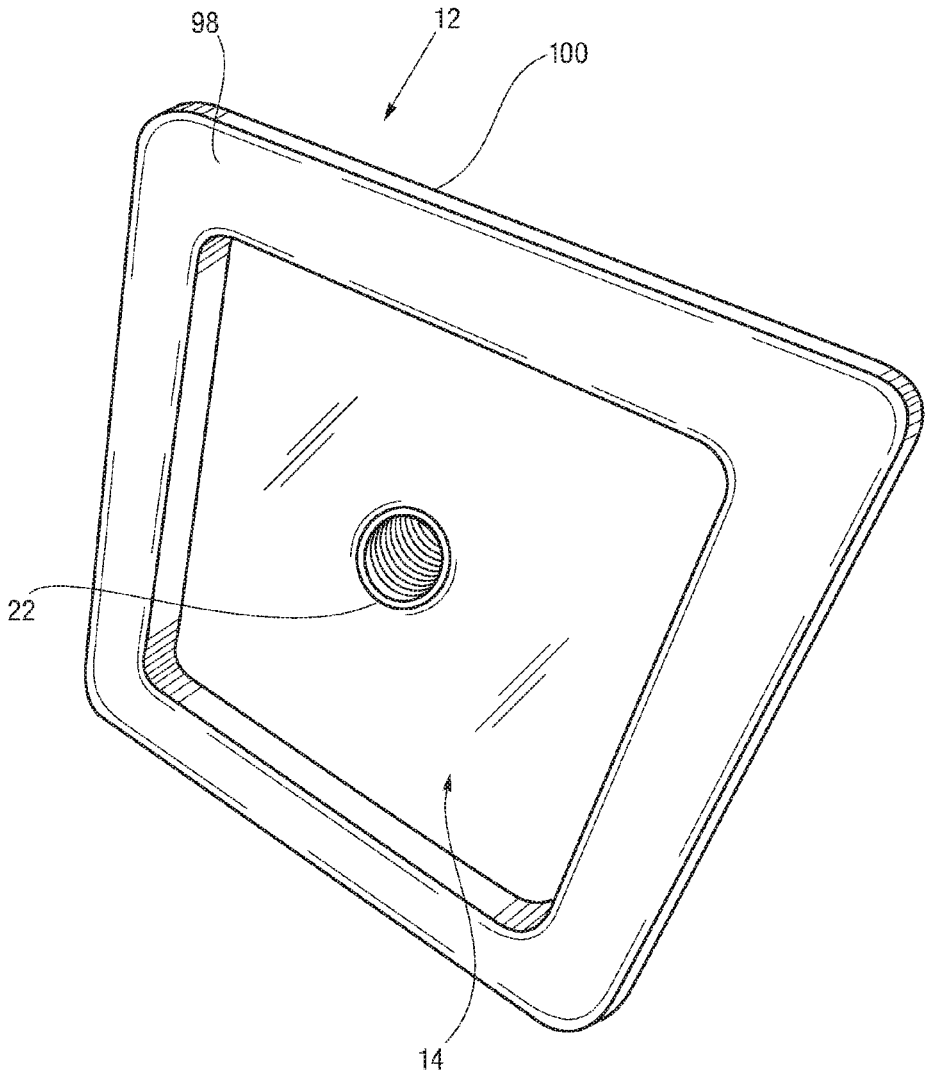
FIG. 7 is a bottom perspective view of a contact surface of a suction head of the paver moving tool showing a suction-head throughbore defined within the contact surface and showing a descending lip of compressible, gas-impermeable material secured adjacent a perimeter edge of the contact surface of the suction head.

FIG. 7 shows a bottom perspective view of the contact surface 14 of the suction head 12 of the paver moving tool 10. FIG. 7 also shows the suction-head throughbore 22 defined within the contact surface 14. FIG. 7 also shows a descending lip 98 of compressible, gas-impermeable material 98 secured adjacent a perimeter edge 100 of the contact surface 14 of the suction head 12. A preferred material 98 is a silicone memory foam that is commonly available as weather stripping with an adhesive layer, and preferably between 0.25 and 0.75 inches thick.

This compressible lip 98 facilitates application of the vacuum force between the contact surface and a paver 20 so that the paver moving tool 10 may lift and move the paver 20 as the vacuum force is applied to the paver 20.

While the present disclosure has been presented above with respect to the described and illustrated embodiments of the hand-held, self-powered paver moving tool 10 with an operator-supported rechargeable vacuum power pack 34, 50, it is to be understood that the disclosure is not to be limited to those alternatives and described embodiments. Accordingly, reference should be made primarily to the following claims rather than the forgoing description to determine the scope of the disclosure. For purposes herein, the word "about" is to mean plus or minus fifteen percent.

What is claimed is:

1. A hand-held, self-powered paver moving tool with an operator-supported rechargeable vacuum power pack, the tool comprising:

a. a suction head having, a contact surface and an opposed attachment surface, the contact surface being configured to be detachably secured adjacent an approximately flat surface of a paver, the suction head defining a suction-head throughbore passing between the contact surface and the attachment surface;

b. a shaft having a bottom end and an opposed top end of the shaft, the bottom end of the shaft being secured to the attachment surface of the suction head;

c. a lift-handle secured to the top end of the shaft;

d. one of a first and second rechargeable vacuum power pack operably coupled in fluid communication with the contact surface of the suction head for selectively applying a vacuum force through the suction-head throughbore to the contact surface, the rechargeable vacuum power packs being configured to be supported by an operator of the self-powered paver moving tool while the operator is using the paver moving tool, the first rechargeable vacuum power pack being supported on the paver moving tool and the second rechargeable vacuum power pack being supported on a backpack on the operator of the tool; and, e. wherein the first and second rechargeable vacuum power packs further comprise a vacuum pump secured to a support assembly, a suction line extending in fluid communication between the vacuum pump and the suction-head throughbore of the suction head, a rechargeable battery detachably secured to a battery mount on the support assembly, an electrical circuit extending in electrical communication between the battery and a vacuum-pump switch on the lift handle and also extending between the battery and the vacuum pump and for selectively providing power to operate the vacuum pump by operation of the vacuum-pump switch.

2. The hand-held, self-powered paver moving tool of claim 1, further comprising a vent valve secured to the suction line and configured to adjustably permit release of one of a portion of and all of the vacuum force within the suction line.

3. The hand-held, self-powered paver moving tool of claim 2, wherein the vent valve is an electrically actuated vent valve secured to the suction line and secured in electrical communication with the power source and with a vent-valve switch secured to the lift-handle adjacent the vacuum-pump switch, wherein the vacuum-pump switch and the vent-valve switch are configured for selective operation by an operator's hand that is simultaneously lifting the lift-handle.

4. The hand-held, self-powered paver moving tool of claim 1, wherein the vacuum-pump switch on the lift-handle is an on/off toggle switch, and further comprising a spring-biased quick-switch secured adjacent the on/off toggle switch and secured in electrical communication between the power source and the vacuum pump that selectively permits and prevents operation of the vacuum pump upon compression and release of the spring-biased quick-switch.

5. The hand-held, self-powered paver moving tool of claim 1, wherein the suction line extending between the vacuum pump and the suction-head throughbore includes a first section of the suction line extending between the vacuum pump and one of the shaft and the lift handle, and the suction line also includes a second section in the form of a suction throughbore defined within one of only the shaft and the lift handle and the shaft, wherein the suction throughbore extends from one of a position on the shaft above the bottom end of the shaft to the bottom end of the shaft and from the lift handle and through the shaft and into the suction-head throughbore of the suction head.

6. The hand-held, self-powered paver moving tool of claim 1, wherein the battery mount includes electrical contacts configured to be in contact with electrical contacts of the detachable, rechargeable battery, and wherein the battery mount electrical contacts are positioned to be below the battery electrical contacts, wherein below is with respect to the direction of the force of gravity.

7. The hand-held, self-powered paver moving tool of claim 6, wherein the battery mount includes an adjustable-length, pliable securing strap for separately securing varying size batteries within the battery mount.

8. The hand-held, self-powered paver moving tool of claim wherein the lift handle further comprises an "H"-shaped, two-person lift handle having four lifting hand-grips at four opposed corners of the "H"-shaped, two-person lift handle, and wherein the two-person lift handle includes one of the first and second rechargeable vacuum power packs being secured to one of the shaft, the lift handle of the tool, and a backpack supported by an operator of the tool during operation of the paver moving tool.

9. The hand-held, self-powered paver moving tool of claim 8, wherein the vacuum-pump switch is positioned adjacent one of the four lifting hand-grips.

10. The hand-held, self-powered paver moving tool of claim 1, wherein the first rechargeable vacuum power pack is secured to one of the shaft and the lift-handle.

11. The hand-held, self-powered paver moving tool of claim 1, wherein the second rechargeable vacuum power pack is secured to a backpack configured to be supported on a back of an operator during operation of the paver moving tool, and the suction line extends from the vacuum pump to the lift handle.

12. The hand-held, self-powered paver moving tool of claim 1, further comprising a low-battery power signal secured in electrical communication with the battery, the low-battery power signal being secured to the paver moving tool and also being configured to emit at least one of a visual signal and an audio signal whenever battery power decreases below a pre-determined minimum amount of power.

13. The hand-held, self-powered paver moving tool of claim 1, wherein the suction head includes a descending lip of compressible, gas-impermeable material secured adjacent a perimeter edge of the contact surface of the suction head, the lip extending below the contact surface in a direction away from the attachment surface of the suction head.

14. The hand-held, self-powered paver moving tool of claim 13, wherein the descending lip comprises a silicone memory foam between about 0.25 and 0.75 inches thick.

* * * * *